US006223809B1

(12) United States Patent
Schildmann et al.

(10) Patent No.: US 6,223,809 B1
(45) Date of Patent: May 1, 2001

(54) SCREENING DEVICE FOR ELIMINATING BALLS FROM A COOLANT LINE

(75) Inventors: Hans-Werner Schildmann, Heiligenhaus; Hartono Widjaja, Wetter, both of (DE)

(73) Assignee: Taprogge GmbH (DE)

( * ) Notice: Subject to any disclaimer, the term of this patent is extended or adjusted under 35 U.S.C. 154(b) by 0 days.

(21) Appl. No.: 09/202,648

(22) PCT Filed: Apr. 19, 1997

(86) PCT No.: PCT/EP97/01980

§ 371 Date: Dec. 18, 1998

§ 102(e) Date: Dec. 18, 1998

(87) PCT Pub. No.: WO97/49964

PCT Pub. Date: Dec. 31, 1997

(30) Foreign Application Priority Data

Jun. 21, 1996 (DE) ..... 296 10 898 U

(51) Int. Cl.[7] ..... F28G 1/12
(52) U.S. Cl. ..... 165/95; 15/3.51
(58) Field of Search ..... 165/95; 15/3.51

(56) References Cited

U.S. PATENT DOCUMENTS 3,021,117 * 2/1962 Taprogge ..... 165/95
4,556,102 * 12/1985 Bochinski et al. ..... 165/95
4,974,662 * 12/1990 Bizard ..... 165/95

FOREIGN PATENT DOCUMENTS

1238939 * 4/1967 (DE) ..... 165/95
58-208598 * 12/1983 (JP) ..... 165/95
S8-208598 11/1999 (JP) .

* cited by examiner

*Primary Examiner*—Allen Flanigan
(74) *Attorney, Agent, or Firm*—Snell & Wilmer L.L.P.

(57) ABSTRACT

A screening device for eliminating balls (6) for cleaning the tube of a heat exchanger, condenser or the like from a coolant line (7) comprises a screen (2) located in the outlet area of the heat exchanger, able to cover the free cross section of the coolant line (7) for collecting the balls (6) and progressively restricting the free cross section for the coolant for the collection of the balls (6) in the cooling medium flow direction and a removal line (3), positioned in the flow direction of the cooling medium behind the screen (2) in such a way that the balls (6) collected by the screen (2) are passed into the removal line (3) and leave the coolant line (7) via the removal line (3). For obtaining a less expensive construction for the screening device the screen (2) is fixed to the wall (7*a*) of the coolant line (7).

5 Claims, 1 Drawing Sheet

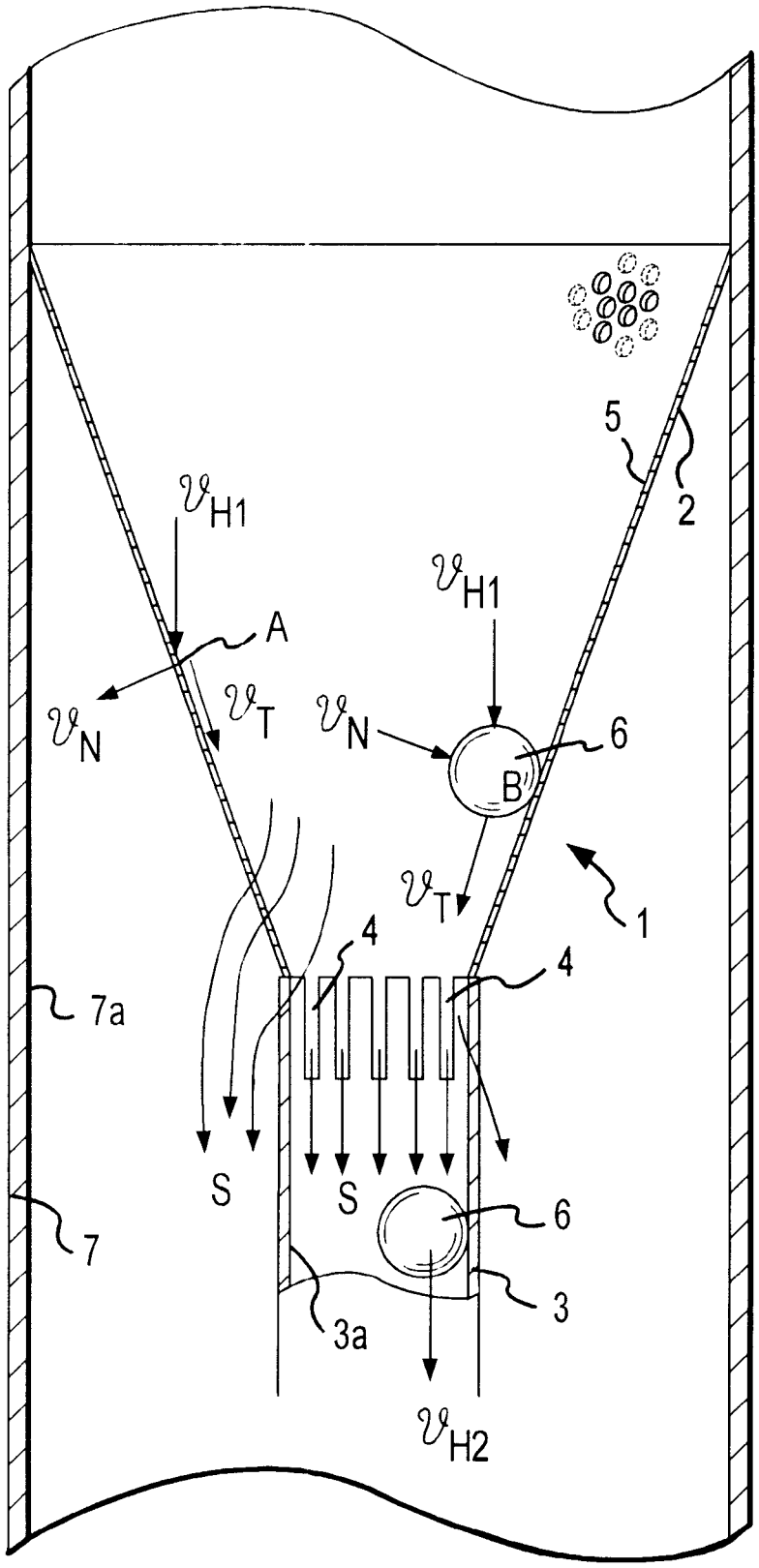
5
2
$v_{H1}$
$v_{H1}$
A
$v_N$
$v_T$
$v_N$
6
B
$v_T$
1
4
4
7a
S
S
6
7
3
3a
$v_{H2}$

SCREENING DEVICE FOR ELIMINATING BALLS FROM A COOLANT LINE

The invention relates to an apparatus for eliminating balls for cleaning the tubes of a heat exchanger, condenser or the like from a coolant line, comprising the coolant line having a wall, a screen being fixed to the wall of the coolant line and being located in the outlet area of the heat exchanger, the screen (2) being able to cover the free cross-section of the coolant line for collecting the balls and progressively restricting the free cross-section For the coolant for the collection of the balls in the cooling medium flow direction and a removal line, positioned in the flow direction of the cooling medium behind the screen in such a way that the balls collected by the screen are passed into the removal line and leave the coolant line via the removal line, the screen passing in funnel-shaped manner from the wall of the coolant line to the opening of the removal line, openings for the outlet of cooling medium being located in the removal line in the coolant line.

In a known apparatus of this type —DD 218 168 A1— the removal line is connected to the funnel-shaped screen by a closed first section of the removal line. Downstream this section of the removal line has an oblique open end which is arranged under an angle with regard to the flow direction of the cooling medium and which is covered with a grid being connected to the edge of the wall of the removal line surrounding the opening. At the wedge-like lower end of the open end of the downstream end of the removal line a suction tube is connected which has a small diameter and which serves to remove the balls from the grid to an outlet . Accordingly the balls being collected in the funnel-shaped screen and the cooling medium flowing in the middle area of the coolant line have to pass the closed first section of the removal line until they reach the grid where a main portion of the cooling medium passes the grid in the flow direction of the cooling medium while the balls which are to be removed via the suction tube tend to be pressed to the grid under the pressure of the cooling medium passing the openings of the grid.

In other known apparatus of this type, e.g. for heat exchangers, for eliminating the balls from the coolant line use is made of screens mounted in rotary manner and whose screen faces are so inclined in the active position relative to the flow direction that the balls pass via the screen surface to an outlet in the coolant line, from where they are transported away by means of the removal line and a pump and are returned to the inlet area of the heat exchanger. If the screens are pivoted into an inactive position, the coolant flows in unimpeded manner through the screens, which are flushed back and consequently freed from adhering dirt.

In smaller heat exchangers the known apparatus comprising screening devices make the plant much more expensive due to the complicated construction, the drive and the control of the movable screen parts, as well as the sealing thereof.

Thus, the problem exists of obtaining a less expensive construction for the screening device of the apparatus.

According to the invention this problem is solved in that the openings in the removal line are located in the flow direction immediately behind the transition between the screen and the removal line, the openings are formed in the circular wall of the open end of the removal line and the openings extend in the axial direction of the removal line.

The apparatus according to the invention comprises—like known devices—a removal line and a screen, which covers the free cross-section of the coolant line and extends from the coolant line wall to the removal line opening. The screen of the proposed device is fixed to the coolant line wall and is consequently a permanently operated component within the closed cooling circuit.

The cleaning processes take place at least periodically for removing corrosion and/or deposits in heat exchanger tubes or accumulations of very small parts. The balls release the deposits, which in turn effortlessly pass through he screening device, so that the screen is not impaired as regards its function by the permanent operation and the discharged particles.

Through fixing the screen in the coolant line, the technical expenditure for this device is much lower than in movable screens. Simultaneously the stability of the arrangement is considerably increased, so that supporting and holding frames for the screen are rendered superfluous. This reduces manufacturing costs and also greatly simplifies manufacture.

The movable screens from the outset greatly restrict constructional possibilities and lead to a compromise between the requirements for the movable mounting and the requirements for a favourable collecting action.

The problem of the transfer from the screen at the outlet and removal line can be constructionally simply solved, because it also allows a fixed connection of the screen to the removal line.

Thus, all the balls contained in the cooling medium are passed through the screen into the removal line.

The entire free cross-section of the coolant line is available to the screen, which reduces the flow resistance compared with non-fixed screening devices, because in movable screens the free cross-section is limited by shields or frame-like stabilizers for the screens.

The screen passes in funnel-shaped manner from the coolant line wall to the removal line opening. As a result of the funnel shape of the screen there is an intensive collecting action. The screening action of the funnel-shaped screen allows the construction of the device with a limited overall length. Thus, compared with movable screens, the proposed screening device has a smaller overall length in addition to the simpler construction.

The screen of the apparatus according to the invention can be implemented as a straight or inclined cone-shaped shell, as a function of the arrangement of the removal line in the coolant line. However, advantageously the funnel-shaped screen is symmetrical to the coolant line axis, i.e. it is rotationally symmetrical. This ensures that in any plane perpendicular to the centre axis of the coolant line, on the surface of the screen the same conditions prevail at all points for the speed of the balls. In addition, in the development of the conical or cylindrical parts only straight or circular lines occur. This simplifies the cutting of the materials in manufacture and therefore reduces costs.

In the transition area between the screen and the removal line, the flow conditions for the coolant change considerably as a result of the modification to the geometry. In order to minimize the thermodynamic losses, the flow rate in the removal line is generally much lower than in the coolant line. In addition, in said transition area the velocity or speed component of a ball, which is perpendicular to the screen surface, is the same or even greater than the tangential component of the speed or velocity. The consequence thereof can be that balls can collect in the transition area between the screen and the removal line. Consequently they are no longer available for the cleaning passes and in extreme cases lead to the clogging of the screening device.

For a high efficiency of the plant it is desirable that even in the case of a small quantity of balls to be returned , no ball accumulations or blockages occur at the critical transition point. According to a further feature of the invention the openings are provided in the circular removal line wall of the open end of the removal line for this purpose. They are located in the area of the removal line which passes into the coolant line. Considered in the coolant flow direction, the openings are positioned immediately behind the transition between the screen and the removal line in the area in which a comparatively high flow resistance acts on the volume flow flowing at a high intake speed due to the small removal line diameter.

According to the invention the speed components of the balls parallel or tangential to the screen surface are to be high on entering the suction cross-section, i.e. the removal line opening, for a reliable conveying away of the balls. This can only be attained by a comparatively high volume flow entering through the transition point into the removal line. According to the invention, the volume flow flowing rapidly into the removal line can be used, because a considerable part of this volume flow, immediately behind the transition, can flow back through the openings from the removal line and into the coolant line, whereas the other part passes into the slower volume flow in the removal line and takes over the further transportation of the balls. Thus, there is no flow rate reduction within the screening device and there is a reliable conveying away of the cleaning balls through the transition area between screen and removal line.

As outlined above the openings are located immediately behind the transition of the funnel-shaped screen into the removal line and they extend in the direction of the removal line axis in the tube wall and removal line respectively. At this point there is a constriction of the free tube cross-section from the coolant line diameter to the much smaller diameter of the suction or removal line. However, in this area, the increased flow resistance has not yet completely acted on the coolant. This leads to an optimum minimizing of the residual volume flow for the conveying of the balls in the removal line.

The balls cannot pass through the openings in the removal line and consequently remain in the latter, where they can be conveyed away by the reduced volume Flow by using pumps. The openings in the removal line are preferably slot-like for this purpose. This also avoids a pronounced mechanical weakening of the removal line.

The openings can have rectangular, square or oval, as well as rounded contours and consequently make no particularly high manufacturing demands. When dimensioning the width account need only be taken of the diameter of the balls, because even in the case of maximum permitted wear and also under the influence of the flow, the balls must not pass through the openings from the removal line into the coolant line.

Thus, the openings made in the described manner in the removal line walls preferably have a total surface area representing at least 20% of the crosssectional surface of the removal line.

The apparatus according to the invention has a simple overall construction and a very compact size. Its construction also makes it easily housable within a tube bend in the coolant line. As a result of the use of a high volume flow in the critical transition area between the screen and the removal line, the screening device according to the invention is also suitable for installations having a small ball return quantity, because the cleaning balls can reliably pass this threshold at a comparatively high speed. The following minimizing of the volume flow through the openings in the removal line recommends the use of this compact screening device more particularly in plants with small cooling water flows and therefore also small thermal performance levels, because the thermodynamic losses through this device are also low due to the limited coolant transport flow for the elimination of the balls.

An embodiment of the invention is described hereinafter relative to the drawing. The drawing is a longitudinal section through a screening device 1. The screening device 1 comprises a funnel-shaped screen 2 and a removal line 3, in which are formed slot-like openings 4, which are connected to the end of the funnel-shaped screen 2.

At A the speed or velocity $_{H1}$ at the surface 5 of the funnel-shaped screen 2 is shown in a vectorial splitting into its normal component $_N$ (perpendicular to the surface 5 of the screen 2) and tangential component $_T$ (parallel to the surface 5). It is clear that the normal component $_N$ is much smaller than the tangential component $_T$ of the speed, so that no balls 6 can collect at this point A. A comparable situation occurs on splitting the speed $_{H1}$ into its normal component $_N$ and tangential component $_T$ also at a point B, immediately upstream of the transition of the funnel-shaped screen 2 into the removal line 3. The high tangential component $_T$ of the speed $_{H1}$ also prevents a collection of balls 6.

Flow lines S indicate the cooling medium flow through the screening device 1. They also indicate that through the openings 4 in the removal line 3, in the case of a speed change from the high value $_{H1}$ to the lower value $_{H2}$ in the removal line 3 a considerable proportion of the transport volume passes out of the line 3 through the openings 4 and back into the coolant line 7.

For stability reasons, the funnel-shaped screen 2 constructed symmetrically to the centre axis is fixed to the coolant line wall 7*a* and consequently keeps the entire screening device 1 in the coolant flow without any additional frame at the ends of the screen 2. At the connection point of the screen 2 and the wall 7*a*, equal tensile forces occur along the circumference of the internal diameter of the coolant line 7.

The drawing shows the compact, simple construction of a screening device with a funnel-shaped screen.

What is claimed is:

1. Apparatus for eliminating balls (B) for cleaning the tubes of a heat exchanger, condenser or the like from a coolant line(7), comprising the coolant line (7) having a wall (7*a*), a screen (2) being fixed to the wall (7*a*) of the coolant line (7) and being located in an outlet area of the heat exchanger, the screen (2) being able to cover a free cross-section of the coolant line (7) for collecting the balls (6) and progressively restricting the free cross-section of the coolant line (7) for the collection of the balls (6) in a cooling medium flow direction and a removal line (3), positioned in the flow direction of the cooling medium behind the screen (2) in such a way that the balls (6) collected by the screen (2) are passed into the removal line (3) and leave the coolant line (7) via the removal line (3), the screen (2) passing in funnel-shaped manner from the wall (7*a*) of the coolant line (7) to an open end of the removal line (3), openings (4) for the outlet of the cooling medium being located in the removal line (3) in the coolant line (7), characterized in that the openings (4) in the removal line (3) extend from the open end of the removal line (3), the openings (4) are formed in a circular wall of the open end of the removal line(3) and the openings (4) extend in an axial direction of the removal line (3).

2. Apparatus according to claim 1, characterized in that the screen (2) is symmetrical to the axis of the coolant line (7).

3. Apparatus according to claim 1, characterized in that the openings (4) in the removal line (3) are slot-like.

4. Apparatus according to claim 1, characterized in that the openings (4) in the removal line (3) have rectangular, square or oval, as well as rounded contours.

5. Apparatus according to claim 1, characterized in that the openings (4) in the removal line (3) in the sum of their surfaces are greater than 20% of the cross sectional surface of the removal line (3).

* * * * *